US005199645A

United States Patent [19]

Anderson et al.

[11] Patent Number: 5,199,645

[45] Date of Patent: Apr. 6, 1993

[54] SPRINKLER SYSTEM CONVERSION KIT

[76] Inventors: Keith A. Anderson, Rte. 2 Box 448, Jacksonville, Tex. 75766; Christopher N. Green, 724 Lewelling Blvd., Apt. 309, San Leandro, Calif. 94579

[21] Appl. No.: 835,360

[22] Filed: Feb. 14, 1992

[51] Int. Cl.[5] ..... B05B 7/26

[52] U.S. Cl. ..... 239/310; 137/268; 137/584

[58] Field of Search ..... 239/302, 310, 315, 316, 239/582.1, 581.1; 137/268, 584; 251/144; 222/153

[56] References Cited

U.S. PATENT DOCUMENTS

| | | | |
|---|---|---|---|
| 1,806,025 | 5/1931 | Seaman | 239/315 |
| 1,827,502 | 10/1931 | Alland | 137/584 |
| 2,981,284 | 4/1961 | Putnam | 239/581.1 |
| 3,275,194 | 9/1966 | Moulder | 239/316 |
| 3,343,918 | 9/1967 | Moulder | 239/310 |
| 3,370,571 | 2/1968 | Knapp . | |
| 3,482,740 | 12/1969 | Evans et al. | 239/310 |
| 3,759,423 | 9/1973 | Hansel | 222/153 |
| 3,771,968 | 11/1973 | Stalnaker | 239/310 |
| 3,772,193 | 11/1973 | Nelli et al. | 137/268 |
| 3,937,399 | 2/1976 | Halley | 137/268 |
| 4,206,877 | 6/1980 | Hoza, III | 239/581.1 |
| 4,249,562 | 2/1981 | King, Sr. | 239/310 |
| 4,250,911 | 2/1981 | Kratz | 239/310 |
| 4,333,493 | 6/1982 | Beiswenger et al. | 137/268 |
| 4,340,078 | 7/1982 | Pasley | 239/310 |
| 4,340,179 | 4/1980 | Knapp | 239/310 |
| 4,763,837 | 8/1988 | Livneh | 239/111 |
| 4,881,568 | 11/1989 | Ho | 239/310 |

FOREIGN PATENT DOCUMENTS

| | | | |
|---|---|---|---|
| 464244 | 4/1937 | United Kingdom | 239/315 |

*Primary Examiner*—Andres Kashnikow
*Assistant Examiner*—Christopher G. Trainor
*Attorney, Agent, or Firm*—Terrance L. Siemens

[57] ABSTRACT

A conversion kit for converting an existing sprinkler system liquid supply line into a general purpose soluble chemical application device is used to apply insecticides or fertilizer. The easily installed kit mixes dry chemicals with an existing pressurized liquid to form and expel appropriate treatment solution. Spent dry chemicals can be easily replaced in a removable canister. Chemicals from conventional bulk packages or specially prepared packets may be used. A safety interlock shutoff valve is provided to prevent pressurization of the system while chemicals are being replaced. A vacuum breaking air vent valve is provided to allow drainage of liquid from the system. All components are enclosed within and supported by a single housing. The housing is preferably molded from a durable plastic material.

11 Claims, 3 Drawing Sheets

SPRINKLER SYSTEM CONVERSION KIT

FIELD OF THE INVENTION

This invention relates broadly to the field of fluid mixing and dispersal, more particularly to lawn care and maintenance, and most specifically to a conversion kit for easily converting an existing lawn or crop sprinkler system to a general purpose water and nutriment feeding system as well as an effective insecticide distribution system. The invention also relates to the field of environmental preservation, more specifically to the minimization of the runoff of harmful materials into streams, lakes and underground water aquifers. Significant contributions are made to these fields by providing a new, useful and inexpensive apparatus which is easily attached to any conventional existing sprinkler system. The primary benefit to environmental preservation is that the potentially injurious fertilizer or insecticide materials are automatically premixed with the water to be applied to the lawn or crop in precisely controlled amounts. This lessens the chance of potentially high concentrations of such material in runoff or waste water. It will become immediately evident that the unique properties of the apparatus herein disclosed will provide important benefits in many areas. The conversion kit of this invention may be adapted for use in any field in which it is desired to controllably introduce a soluble material into a fluid stream. As such it will be appreciated that the potential uses are myriad. A comprehensive listing of all the possible fields to which this invention may be applied is limited only by the imagination and is therefore not attempted here. Some of the more obvious applications are mentioned herein in the interest of providing a full and complete disclosure of the unique properties of this previously unknown general purpose article of manufacture. Lawn and garden feeding and environmental preservation are seen as the fields most likely to gain immediate and substantial benefit from this invention. It is to be understood from the outset that the scope of this invention is not limited to these fields or to the specific examples of potential uses presented hereinafter.

BACKGROUND OF THE INVENTION

In its broadest aspect, this invention relates to attachments which controllably introduce fluid soluble material into a pipeline fluid stream. Applications for such devices include the chlorination of swimming pools, water purification processes, insecticide distribution systems, and fertilizer application systems. The production and distribution of plant fertilizer in solid form such as in pellets or powders is common practice even though a liquid solution is required to benefit the plant life. It makes economic sense to distill the essence of the substance into a light weight solid form for shipping and selling and to leave the final mixing with water to the final user. Often the dry pellets are simply spread over the ground area and followed with a general watering or sprinkling to dissolve the pellets and provide plant useable nutrient. This process inevitably leads to grossly uneven distribution of the fertilizer causing damage to plants in some areas and insufficient nutrient in others. Also the plant leaves, which are capable of absorbing liquid nutrients, are not fed by this process. In addition, a heavy rain can wash away large quantities of the solid nutrient before it has a chance to dissolve and be absorbed by the plant roots. This not only starves the plants but, even worse, it contaminates the geographic water drainage basin endangering marine life and possibly polluting human water sources.

Another approach often used is to manually mix batches of liquid fertilizer from the dry raw ingredients prior to application which then usually must also be done manually. The dependence on the user to prepare the solution to its proper concentration as well as the considerable inconvenience make this approach both unreliable as well as impractical.

DESCRIPTION OF THE PRIOR ART

Several United States Patents have been granted which strive for solution of the above mentioned problems or otherwise show some features similar to those of this invention. Knapp, U.S. Pat. No. 4,186,913, and Beiswenger et al, U.S. Pat. No. 4,333,493, are considered pertinent prior art. Both show lawn and garden feeding apparatus for attachment to an above ground "hose type" manual water sprinkler system. Their devices are not designed for use with an automated water sprinkler system which might unexpectedly become pressurized at any time and they lack the safety interlock elements of this invention. Pasley, U.S. Pat. No. 4,340,078, shows a plant nutrient feeding system for use with an automatic underground sprinkler system but doesn't show the safety interlock of this invention. Livneh, U.S. Pat. No. 4,763,837 shows a typical subterranean automatic sprinkler system of the type this invention could convert into an automatic fertilizer and insecticide distribution system. Knapp, U.S. Pat. No. 3,370,571, shows a timer operated sprinkler system for producing and dispensing an insecticide liquid in an animal husbandry environment. King, Halley, and Kratz, U.S. Pat. Nos. 4,249,562, 3,937,399, and 4,250,911 respectively, show similar in-line dispersal units for dissolving solid chemicals into a liquid flow stream in a swimming pool treatment environment. None of the above prior art, taken singly or in combination, anticipates or makes obvious the invention claimed herein.

SUMMARY OF THE INVENTION

The preferred embodiment of this invention provides a device in the form of a conversion kit suitable for unattended infusion of water soluble solid chemicals into the water supply lines of an existing automatic underground lawn sprinkler system such as might be found in modern housing units. A safety interlock is provided to prevent accidental pressurization of the system during maintenance or refilling. One skilled in the art will recognize the obvious extension of the principles involved to golf course and crop irrigation sprinkler systems.

Briefly, the invention comprises: (1) a hollow housing capable of being easily inserted into any straight section of a pipeline; (2) a removable hollow slotted canister inserted in the housing; (3) a safety interlock valve which shuts off the pipeline flow when the canister is removed from the housing; and (4) an air vent valve for allowing vacuum release and drainage when the pipeline is depressurized. The materials used for the components are conventional and generally chosen to provide adequate service at minimum cost.

A major object of this invention is to provide a new and improved apparatus for infusing a solid chemical into an existing fluid flow in a pipeline.

Another object is to provide a new and improved apparatus for converting existing water sprinkler systems into an arrangement for the automatic preparation and application of liquid fertilizer, insecticides or fungicides.

Another object is to provide the apparatus above such that it may be inexpensively manufactured and sold in conversion kit form.

Another object is to provide such an apparatus capable of being quickly and easily installed, even on complex automated sprinkler systems, without any major modification to the main system components.

Another object is to provide such an apparatus with a simple but foolproof safety mechanism for positively preventing accidental dousing of the user with potentially toxic material during maintenance or replenishment of chemicals.

A general goal is to provide improved elements and arrangements thereof in an apparatus for the purposes described which is inexpensive, dependable, and fully effective in accomplishing its intended purpose.

It is submitted that the present invention meets or exceeds all the above objects and goals. Upon further study of the specification and appended claims, further objects and advantages of this invention will become apparent to those skilled in the art.

BRIEF DESCRIPTION OF THE DRAWINGS

Various other objects, features, and attendant advantages of the present invention will become more fully appreciated as the same becomes better understood when considered in conjunction with the accompanying drawings, in which like reference characters designate the same or similar parts throughout the several views, and wherein.

DETAILED DESCRIPTION OF THE INVENTION

Figure 1:
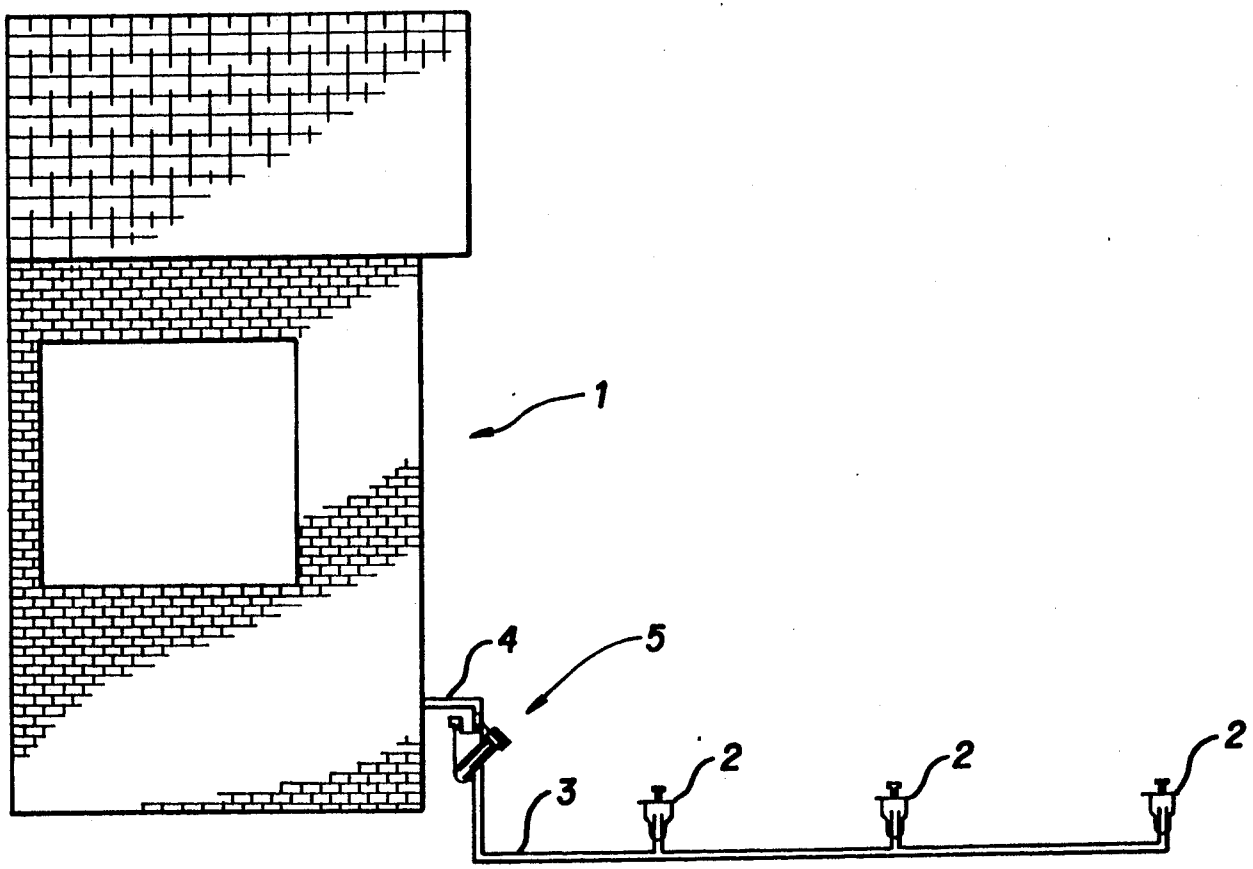
FIG. 1 is an elevation view of a conventional subterranean sprinkler system showing the general placement of the conversion kit of this invention.

In FIG. 1 conventional building 1 is shown whose surrounding grounds are equipped with a subterranean sprinkler system. The building may be in the form of a conventional suburban household or merely a pumphouse type shed for protecting mechanical equipment. The sprinkler system may be fitted with a conventional automatic timer and flow control devices (not shown) as is well known in the art. Outside (the building) portions of the sprinkler system shown schematically for reference are main feeder pipe 4, underground feeder network 3, and several sprinkler heads 2. Main feeder pipe 4 is shown exiting from building 1 at a higher elevation than the feeder network 3 although this is not necessary for satisfactory operation of this invention. It is to be understood that feeder network 3 may have branches and loops generally in the underground plane of the single pipe shown here only schematically. The feeder network 3 may be sloped downwardly away from the building to allow for drainage and or purging of the system upon depressurization. The loops and branches of feeder network 3 feed pressurized water to a number of sprinkler heads 2 which are strategically located around the ground surface. The ground surface is usually covered with a grass lawn but various flowering plants, bushes, and gardens may be present. The sprinkler heads 2 have their upper outlet portions substantially at ground level and are arranged to provide an even distribution of water to the overall surface of the lawn. The conversion kit apparatus 5 of this invention is shown connected in line with the downwardly extending pipe connecting main feeder pipe 4 with underground feeder network 3.

Many possible feeder network layouts are within the purview of this conversion kit invention and solutions might be chosen in accordance with the design considerations with regard to the particular network. For example, if more than one main feeder pipe were present it would be possible to install a separate conversion kit on each. If a particularly high flowrate were present in a main feeder pipe, as in a large agricultural irrigation system, it would be possible to install several conversion kits in series along the pipe. When using multiple conversion kits in this manner there is no requirement that they all be identical in size. In other words it is contemplated that the conversion kit might easily be formed in several sizes and capacities to match the job to be done.

The conversion kit 5 serves to transform the conventional sprinkler system thus far described into a general purpose lawn and garden care and feeding system. The manner in which this is accomplished will be better understood upon consideration of the following detailed description of FIGS. 2 and 3 which show the elements of the kit in assembled and unassembled form respectively. It is contemplated that the kit could be easily installed by the average homeowner using ordinary household tools. Basically all that is involved is the removal of a short straight exposed section of pipe and the insertion of the kit in its place. Appropriate fitting (not shown) for attaching the inlet portion 4 and outlet portion 3 of kit 5 to the existing pipe may be provided as part of the kit or sold separately depending on marketing strategy.

Figure 2:
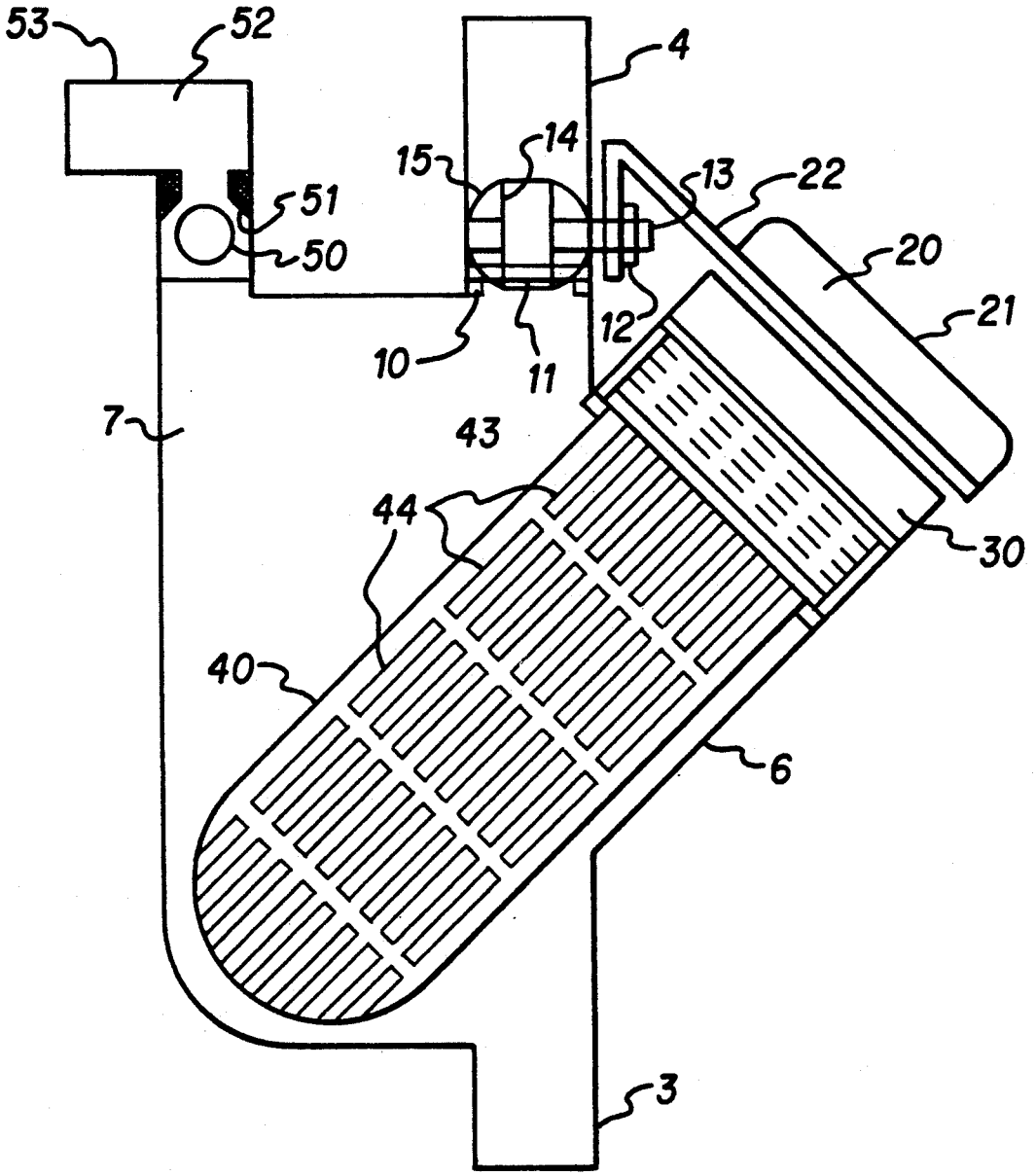
FIG. 2 is a side view of the assembled invention treated as though the outer walls were transparent so as to reveal the inner components.
Figure 3:
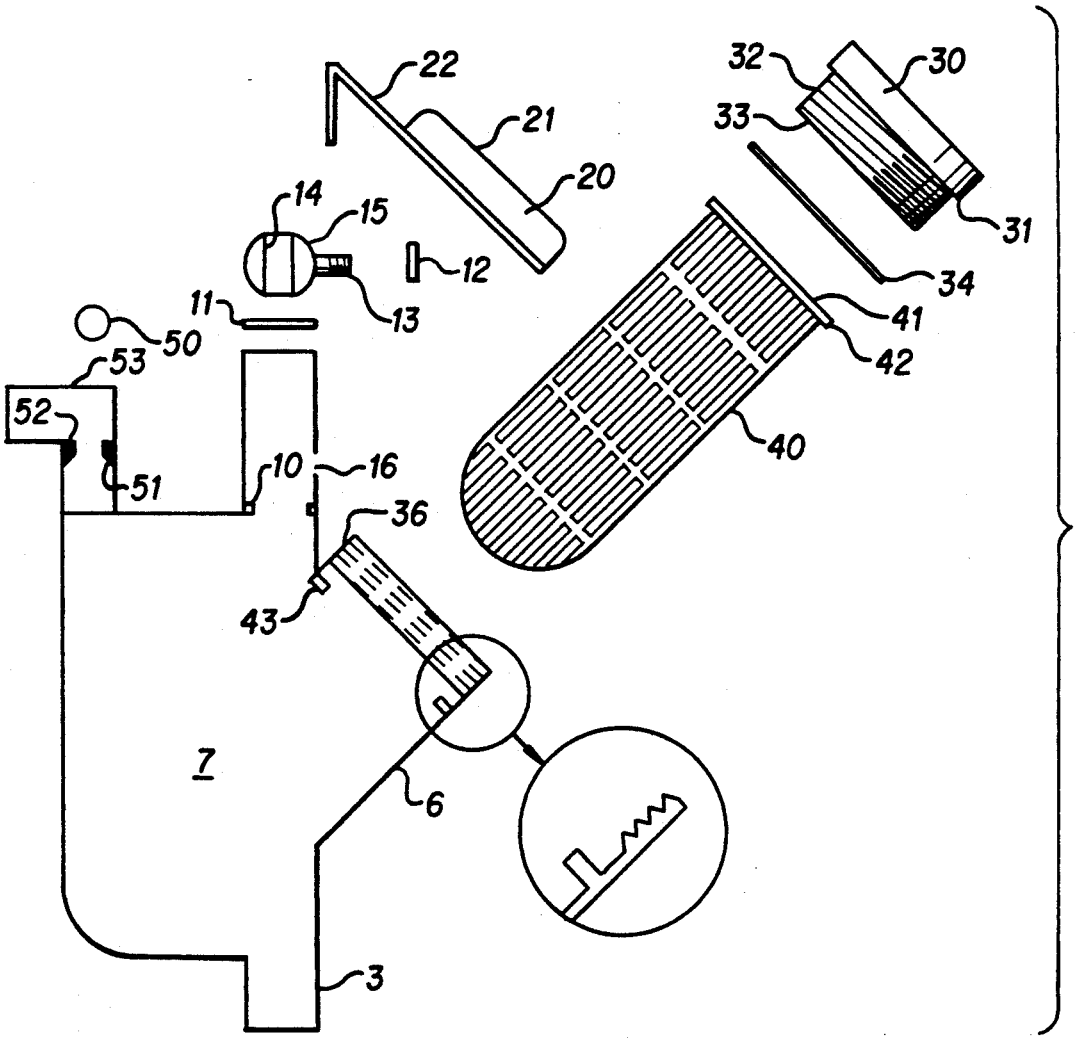
FIG. 3 is an exploded view of the invention showing details of the several elements making up the overall conversion kit of this invention

Referring now to FIGS. 2 and 3, all elements of kit 5 are supported by main housing 7 which surrounds an internal volume having four major sealable openings. Housing 7 is designed to withstand internal pressure without rupturing. The housing is made from any lightweight corrosion resistant material. Opaque or transparent polyvinyl chloride compositions would be suitable as primary material for the main housing. The complex surfaces of the main housing could then be easily be formed by molding. With a transparent material it would be easy for the user to visually determine the extent of erosion of the enclosed chemicals.

The first two of the major openings are inlet portion 4 at the top of housing 7 and outlet portion 3 at the bottom of the housing. They are generally cylindrical in shape and size to easily but permanently attached to a cut out section of an existing fluid supply line. Inlet portion 4 and outlet portion 3 are shown in line with one another but it is contemplated that other alignments could be provided. Of course, a sealed pressure tight joint will be formed at both of these openings by the use of appropriate pipe fittings during installation.

A third major opening 53, sealed during normal operation, is formed at the top of housing 7 forms part of an air vent valve. Operation of the air vent valve is more fully described later.

A fourth major opening generally cylindrical in shape is provided in housing 7 for removal and insertion of chemical bearing canister 40. As best shown in the magnified portion of FIG. 3, this opening is ringed by internal threads 36 at its outer end and canister support shoulder 43 at its inner end. The cylindrical axis of this canister opening is inclined approximately 45 degrees from the common axis of the inlet and outlet portions so as to face upwardly and to one side of housing 7 in a position of easy access. The canister opening is covered and sealed during normal operation by means of cap 30.

Cylindrical cap 30 has shoulder 31 formed between its upper portion and the reduced diameter external threads 32. This shoulder is designed to compress sealing ring 34 against the outer surface of the canister opening on housing 7 upon engagement and tightening of complementary threads 32 and 36. The top of cap 30 is a relatively large diameter to provide an easy means of hand tightening while still insuring a pressure tight seal. Lower portion 33 of cap 30 is intended to securely hold canister 40 in place by pressing canister shoulder portion 42 against canister support should 43 inside housing 7.

Chemical bearing canister 40 has generally cylindrical side walls with a hemispherical bottom portion and an open top. It has an outside diameter just small enough to allow it to easily slide into the canister opening in housing 7. This sliding insertion into housing 7 can proceed freely until canister shoulder 42, formed on the top of the canister, contacts canister support shoulder 43 formed inside housing 7. The side walls and the hemispherical bottom portion of canister 40 contain a plurality of regularly spaced elongated slots 44 to allow liberal fluid passage in and out of the interior portion of the canister. In operation the interior portion of the canister is normally filled with solid chemical pellets. Water from the inlet portion 4 passes through slots 44, mixes with and dissolves some of solid chemical, continues out of others of the slots 44, and finally passes onward to the sprinkler network through outlet portion 4. The elongated slots 44 are narrow enough to prevent large solid chunks of chemical pellets from washing downstream yet wide enough to allow sufficient fluid passage. It will be recognized by those skilled in the art that the number of slots as well as their total flow area can be chosen to provide for a selected downstream concentration of dissolved chemical.

It is contemplated that, if the solid chemical were in small granule or powdered form, a fine mesh liner bag could be used inside the main canister 40. A nylon fabric, such as used in women's hosiery, or metallic fabric would be a suitable material for reusable liner bag. It would also be possible to package the chemical in porous disposable bags, similar to tea bags, suitable for placing in the canister. As an alternative to a liner bag, a suitable fine mesh material could be molded integral with the canister.

Upper opening 53 is exposed to the atmosphere and pressurized internal fluid is prevented from escaping through this opening by means of floating ball 50 which seats against the conical surface 51 of seal 52. An appropriate screen or grille is provided beneath ball 50 to hold it near seal 52 and prevent its escape into the main cavity formed by housing 7. In concert these elements form an air vent valve which allows air to enter the feeder network 3 at such times as it may be desired to drain the system of liquid. It is contemplated that compressed air might be introduced at opening 53 to completely purge the system of liquid. For example, this may be desired to prevent winter freezing in northern climates.

The remainder of the description concerns the components which taken together make up a safety interlock shutoff valve. Inlet portion 4 of housing 7 contains a ball valve 15 including passageway 14 which may be rotated so as to either pass or block fluid flow through the inlet. When the axis of passageway 14 is aligned with the axis of inlet portion 4 it will be seen that fluid can pass substantially unimpeded through ball 15. However, when the axis of passageway 14 is rotated approximately 90 degrees, fluid flow through inlet portion 4 is blocked. Rotation is possible about the axis of stem 13 integral with ball 15 and extending through a hole 16 on the side of inlet portion 4 which faces the canister opening internal threads 36. Stem 13 is journalled snugly through hole 16 so as to prevent leakage and still allow rotation of ball. The opposite side of ball 15 is held tightly against or journalled to the opposite side of inlet portion 4. Shoulder 10, formed on the lower end of inlet portion 4, serves to retain a circular seal 11 tightly against the lower portion of ball 15 and prevent leakage past ball 15 into housing 7 when the ball is rotated to its shutoff position. The outer portion of stem 13 is formed to pass through a non-circular mating hole on operating lever 22. Stem 13 is then rigidly attached to lever 22 by means of nut 12 engaging threads on the stem 13. Operating lever 22 extends upwardly from its stem mating hole for a short distance to where it is bent downwardly to the right at an angle of about 45 degrees. The lower portion of the downwardly bent portion (beneath plate 21) is formed as a circular plate of approximately the same diameter as upper portion of cap 30. Lever 22 and integral grip plate 21 form a safety interlock handle 20. When the interlock handle 20 is rotated (about the axis of stem 13) to the position where ball valve 15 will permit fluid flow into housing 7 the downwardly bent portion of lever 22 will closely overlie the upper end of cap 30. In this position the proximity of the circular plate portion of the downwardly bent portion of lever 22 will make it impossible to loosen or remove canister cap 30. In order for the user to open the housing by removing cap 30 it is necessary to first move handle 20 out of the way. The rotation of handle 20 to a position allowing access to canister cap 30 will rotate ball 15 to its shutoff position. The internal grip plate 21 is generally rectangular with rounded corners and extends upwardly from the lower portion of lever 22 to provide a convenient gripping surface for manual operation. The plate 21 may be embossed or otherwise imprinted with user instruction or warning labels.

OPERATION OF THE INVENTION

Once the invention has been installed on an existing water application system, all the user need do is to replenish the solid chemical supply as it becomes deleted. The following steps are illustrative:

First, the cap 30 is exposed by manually rotating handle 20 by means of its grip plate 21. Of course this also shuts off any possible ingress of pressurized liquid into the system as previously described.

Second, the cap 30 is manually removed to expose the chemical bearing canister 40. The exterior surfaces of cap 30 are properly molded so as to make this removal easy.

Third, the canister 40 is refilled with chemical product. This may or may not require the removal of canister 40 from main housing 7 depending upon the nature of chemical additive. It is anticipated that, in most cases, chemical pellets may simply be poured through the canister opening presented by the removal of cap 30 without removing canister 40. In the best case, the chemical may be prepackaged in water soluble packets specifically designed for use with this system. The packets may be color coded for ease of selection and use. Then all that would be required would be to drop in the appropriate packets. In any case, canister 40 may simply be lifted from housing 7 and easily slid back in place should this be necessary.

Fourth, the cap 30 is replaced. The lower portion 33 of cap 30 will automatically accurately position canister 40 within housing 7 as cap 30 is tightened.

Fifth and last, the handle 20 is rotated so as to cover cap 30 and, at the same time, allow normal entrance of pressurized liquid.

When the invention is in normal pressurized operation it will be recognized that the solid chemical pellets enclosed in the canister are dissolved into the liquid flow by virtue of surface contact with the flow. The concentration of the exiting treated solution will be dependent on the circulation pattern within the housing cavity and the total surface area of solid chemical exposed to that circulation. Enhanced circulation patterns are a natural consequence of the inclination of the canister axis with respect to the inlet-outlet flow axes. Enhanced surface contact is promoted by the arrangement and dimensions of the elongated slots in the canister. Both of these factors may be varied in accordance with desired results. For example, flow directing vanes could be formed inside the housing to encourage several passes of the liquid past the solid chemical. The shape of the solid chemical pellets could be varied to present a chosen ratio of surface area to total volume. Also, the axial cross section of the canister could be formed with folds or pleats so as to increase flow turbulence and expose a larger surface area to the flow. These variations are taught here in the expectation that the scope of patent protection, limited only by the appended claims, will include such variations.

It is to be understood that the provided illustrative examples are by no means exhaustive of the many possible uses for my invention.

From the foregoing description, one skilled in the art can easily ascertain the essential characteristics of this invention and, without departing from the spirit and scope thereof, can make various changes and modifications of the invention to adapt it to various usages and conditions.

We claim:

1. A chemical treatment apparatus for the infusion of soluble solid chemicals into a pressurized liquid flow stream within an existing pipeline comprising:

a housing;

inlet means on said housing to receive liquid flow from the pipeline for treatment in said apparatus, said inlet means including shutoff means for selectively blocking said liquid flow;

mixing means within said housing for exposing the surface of said solid chemicals to at least a portion of said liquid flow stream to dissolve a portion of said solid chemicals into said liquid to form a treatment solution, said mixing means including;

canister means for holding said solid chemicals in position to be impinged upon by said liquid flow from said inlet means during operation, said canister means including walls perforated by a plurality of small openings permitting liquid flow therethrough but preventing the passage of said solid chemicals;

cap means for holding said canister means in place and sealing a canister opening in said housing during operation, said cap means being removable to allow easy replenishment of said solid chemicals in said canister means;

outlet means to discharge said treatment solution into the pipeline;

air vent valve means in an air vent in said housing for allowing downstream drainage during depressurization of the pipeline by allowing air to replace drained liquid and for sealing said air vent during normal pressurized operation;

safety interlock means preventing removal of said cap means unless said shutoff means in said inlet means is blocking said liquid flow.

2. A chemical treatment apparatus as in claim 1 wherein;

the existing pipeline is a lawn sprinkler system supply line and, said inlet means, said housing, and said outlet means are adapted to replace a straight section of said supply line thus effectively forming a kit for converting the sprinkler system to a general purpose chemical application system.

3. A chemical treatment apparatus as in claim 1, wherein said safety interlock means comprises;

lever means for operating said shutoff means wherein a portion of said lever means overlies said cap means when said shutoff means is not blocking said liquid flow thus preventing removal of said cap means.

4. A chemical treatment apparatus as in claim 3, wherein said shutoff means comprises a ball valve located in said inlet means and a ball valve operating stem extending from said inlet means adapted for removable but fixed connection to said lever means, and said portion of said lever means which overlies said cap means further includes an integral grip means for facilitating easy manual operation.

5. A chemical treatment apparatus as in claim 4, wherein said integral grip means is imprinted with user instructions.

6. A chemical treatment apparatus as in claim 1, wherein said air vent valve means includes;

a vent passage between the interior of said housing and the atmosphere, a sealing ring with a frusto-conical surface arranged within said vent passage, a floating ball which presses against said frusto-conical surface when sufficient liquid is present in said housing so as to prevent the escape of pressurized liquid into the atmosphere and which drops away from said surface when insufficient liquid is present in said housing so as to allow the atmosphere to freely communicate with the interior of said housing, and means for preventing said floating ball from escaping from near proximity with said sealing ring and into the confines of said housing.

7. A chemical treatment apparatus as in claim 1, wherein said canister means is generally cylindrical in shape with an open top for easy filling with said chemicals and has a generally hemispherical closed bottom for holding a maximum amount of said chemicals with minimal surface area of said canister means, and the longitudinal axis of said generally cylindrical canister is inclined to the axis of said existing pipeline by about 45 degrees so as to both allow for easy removal of said canister means and promote efficient operation of said mixing means.

8. A chemical treatment apparatus as in claim 7, wherein said open top of said canister means includes a generally circular canister shoulder of slightly greater diameter than the diameter of said generally cylindrical canister, said housing includes an internally formed generally circular canister support shoulder of the same diameter of said canister shoulder which permits the passage of said generally cylindrical canister but prevents the passage of said canister shoulder, and said cap means includes a lower portion which presses said canister shoulder against said canister support shoulder when said cap means is tightened to its sealing position, whereby said canister means is easily removable from said housing without tools when said cap means is removed and said canister means is firmly held in a precise position within said housing when said cap means is tightened.

9. A chemical treatment apparatus as in claim 2, wherein said chemicals comprise plant fertilizers.

10. A chemical treatment apparatus as in claim 2, wherein said chemicals comprise insecticides.

11. A chemical treatment apparatus as in claim 2, wherein said chemicals are prepackaged in water soluble packets.

* * * * *